United States Patent [19]

Schloemann

[11] 4,046,679

[45] Sept. 6, 1977

[54] MAGNETIC DRUM MATERIALS SEPARATOR

[75] Inventor: Ernst F. R. A. Schloemann, Weston, Mass.

[73] Assignee: Raytheon Company, Lexington, Mass.

[21] Appl. No.: 636,176

[22] Filed: Nov. 28, 1975

[51] Int. Cl.[2] ..... B03C 1/12

[52] U.S. Cl. ..... 209/212; 209/221

[58] Field of Search ..... 209/219, 212, 221, 223 R, 209/228, 232, 220, 214

[56] References Cited

U.S. PATENT DOCUMENTS

| | | | |
|---|---|---|---|
| 223,901 | 1/1880 | Fritz | 209/221 |
| 1,417,189 | 5/1922 | McCartny | 209/212 |
| 2,827,168 | 3/1958 | Bowers | 209/228 X |
| 2,913,113 | 11/1959 | Gillette | 209/223 R |
| 3,021,951 | 2/1962 | Holt | 209/221 |
| 3,024,910 | 3/1962 | Dulasvirta | 209/219 |
| 3,087,616 | 4/1963 | Pierson | 209/221 |
| 3,133,015 | 5/1964 | Cavanagh | 209/219 X |
| 3,856,666 | 12/1974 | Yashima | 209/219 |

FOREIGN PATENT DOCUMENTS

| | | | |
|---|---|---|---|
| 185,198 | 8/1922 | United Kingdom | 209/221 |
| 401,301 | 11/1933 | United Kingdom | 209/219 |
| 566,636 | 1/1945 | United Kingdom | 209/221 |

*Primary Examiner*—Robert Halper

*Attorney, Agent, or Firm*—Harold A. Murphy; Joseph D. Pannone; John T. Meaney

[57] ABSTRACT

Materials separating apparatus comprising an inclined drum rotatable about its longitudinal axis and having an inner surface comprised of an array of permanent magnets arranged in parallel strips extending circumferentially at an angle to the drum axis, and means for depositing commingled materials within the drum upon the magnet array whereby as the drum and magnet array rotate the magnetic field of the magnets will induce eddy currents in conductive items causing them to move progressively upward and out the upper end of the drum, while nonconductive items will slide downwardly out the lower end of the drum. In another embodiment of the invention a liner is provided over the magnet array to carry magnetic items upwardly to be deposited separately in a chute or the like.

18 Claims, 5 Drawing Figures

MAGNETIC DRUM MATERIALS SEPARATOR

BACKGROUND OF THE INVENTION

This invention relates generally to materials separating apparatus for segregating electrically conductive metals from commingled materials and, in a further embodiment, for additionally segregating magnetic items from the commingled materials.

In copending U.S. patent application Ser. No. 552,576, now U.S. Pat. No. 4,003,850, filed Feb. 24, 1975, and assigned to the same assignee as the present invention, there has been disclosed a materials separator in the form of an inclined ramp having on its upper surface steady-state magnetic means for establishing an alternating series of oppositely directed magnetic fields. Commingled materials are directed in a stream onto the ramp and slide down sequentially through the static series of oppositely directed magnetic fields. Consequently, eddy currents are induced in the electrically conductive items, which eddy currents cooperate with the magnetic fields to exert uniformly directed forces on the conductors. Such forces have a decelerating component directed oppositely to the flow direction of the stream and an orthogonally directed component which draws the conductors laterally out of the stream. The extents of such lateral deflections of the conductors thus provide means for sorting the conductive materials while separating them from nonconductive materials in the stream which slide down the ramp normally undeflected.

Such a ramp-type separator performs quite satisfactorily for useful separation of commingled materials such as are found in municipal solid waste, for example, but may be undesirable in applications where the physical properties of two or more commingled materials are too similar to allow them to be efficiently segregated, or where the particle size of the materials is so small that a sufficiently large deflection cannnot be obtained on the ramp.

It has been established that for a conductive particle sliding on an inclined magnetic ramp, the lateral deflection is proportional to 3/2 power of the ramp length. Thus, in some applications the ramp must be of undesirable length.

The separator described in application Ser. No. 552,576 now U.S. Pat. No. 4,003,850 also has the disadvantage of being very sensitive to magnetic particles in the feed stream. Such particles will adhere to the ramp surface and will therefore degrade the performance of the separator.

SUMMARY OF THE INVENTION

The above and other objections to magnetic materials separators are improved upon or overcome in the present invention by the provision of an inclined drum which is provided on its inner surface with permanent magnets arranged in stripes, the stripe direction being approximately 45° to the drum axis. Means is provided for depositing a supply of commingled materials in the interior of the drum on the wall thereof as the drum is rotated. Because of the angled position of the drum, the nonconductive items will gradually slide downwardly and out the lower end of the drum unaffected by the magnetic fields created by the magnets.

However, conductive materials will be affected by the magnetic fields and by rotation of the drum such that they will gradually move upwardly and out the upper end of the drum. Thus, the drum is effectively the same as an infinitely long ramp from the point of view of an item or particle deposited on the inner surface of the drum.

In a further embodiment of the invention, the drum is provided with a flexible liner of nonmagnetic material which covers the magnet stripes and which rotates with the drum. Magnetic items included in the commingled materials deposited in the drum will be attracted to the liner by the magnetic fields which extend from the magnets through the liner. Thus, movement of the liner when the drum is axially rotated will cause the magnetic items to be raised toward the top of the drum and to a point where they will be separated from the drum and dropped into a chute or other conveying means for removal separately from the remaining materials.

BRIEF DESCRIPTION OF THE DRAWINGS

The above and other advantages of this invention will become apparent from the following description taken in connection with the accompanying drawings, wherein.

DESCRIPTION OF THE PREFERRED EMBODIMENTS

Figure 1:
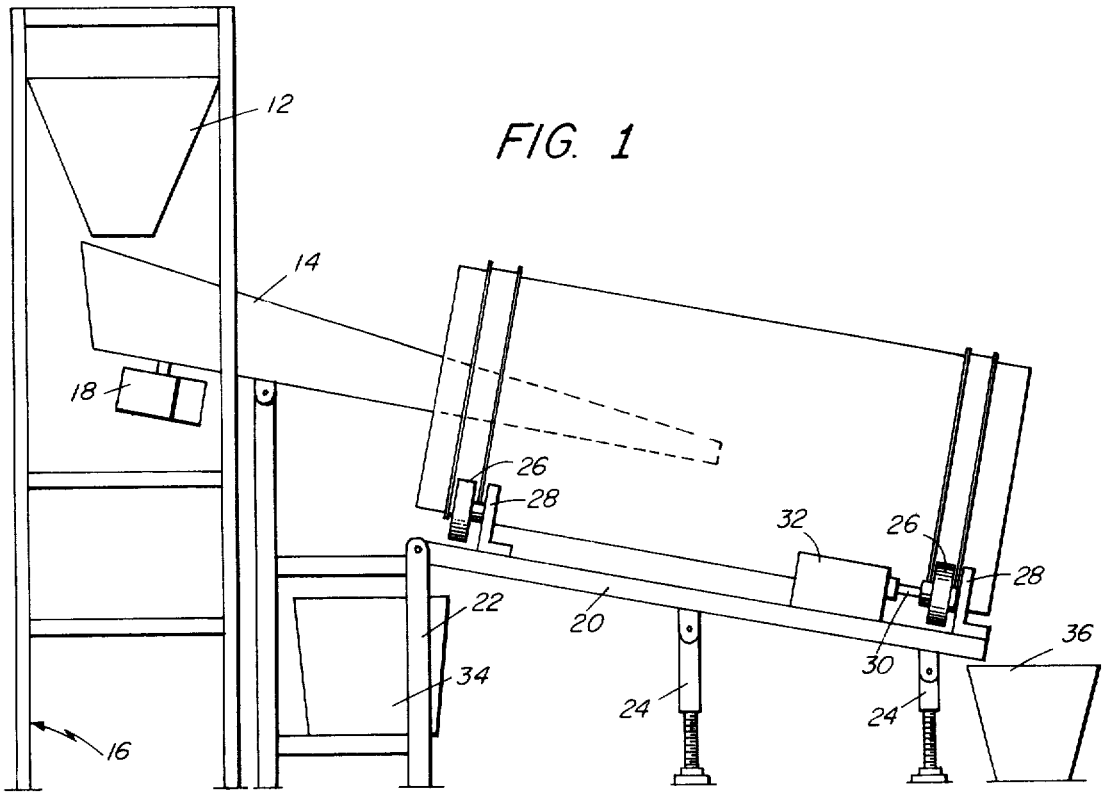
FIG. 1 is a side elevational view of a magnetic rotary drum classifier system embodying the invention.

Referring more particularly to the drawings, the materials separation system shown in FIG. 1 includes a magnetic rotary drum separator 10 and a supply system such as a hopper or bin 12 from which a supply of commingled materials are transported via means such as a vibrating chute 14 to the interior of the drum.

The hopper 12 may be supported in any suitable manner so as to be loaded with commingled materials which are to be separated, such means in FIG. 1 being exemplified by a supporting frame 16. The chute 14, which also may be mounted on a portion of the frame 16, is disposed with its upper end located beneath the outlet of the hopper 12 so as to receive commingled materials therefrom under control of a suitable gate device, not shown. The chute 14 may be of any conventional type disposed at a predetermined angle and including vibratory means 18 to move such materials at a steady rate of feed into the drum 10.

The drum 10 is disposed at an adjusted angle of inclination to the horizontal, such as fifteen degrees, for example, and the lower end of the chute 14 is positioned to allow commingled materials to fall onto the inner surface of the drum at any selected point along its length, such as midway thereof, for example. Drum 10 is mounted on any suitable support such as bed 20, for example, which is pivotally connected at its upper end to a fixed support 22 and is supported along its length by adjustable posts 24. Thus, by vertical adjustment of posts 24 the lower end of the bed 20 and the drum 10 thereon can be raised and lowered to adjust the angle of inclination of the drum for reasons to become apparent hereinafter.

Rotation of the drum 10 about its longitudinal axis may be accomplished in any suitable manner and in the FIG. 1 embodiment this is achieved by positioning the drum upon four rollers 26, two adjacent each end of the drum, which rollers are rotatably mounted in brackets 28 carried by the bed 20. One roller 26 is also connected by a drive shaft 30 to a motor 32 whereby this roller is turned to frictionally rotate the drum. A suitable collector 34 is positioned beneath the upper end of the drum to collect conductive items which are separated in the drum in a manner to be described, and a second collector 36 is positioned beneath the lower end of the drum to collect separated nonconductive items. The collectors may be any suitable devices such as bins or boxes as shown, or may be conveyor systems if desired.

In the construction of the magnetic rotary drum separator, magnets 38 are positioned upon the inner surface of the drum and function to remove conductive items from the commingled materials which are deposited in the drum from chute 14. The magnets 38 are arranged in an array which comprises parallel contiguous rows of oppositely polarized magnets (FIG. 2) disposed on the drum surface at an angle, such as 45° for example, to the drum axis. Each row may comprise a number of small magnets placed end-to-end or may comprise a single long magnet, the magnets being attached to the drum by suitable adhesive or mechanical means. In the embodiment shown in FIGS. 1 and 2 the drum 10 is made of magnetic material such as steel and the magnets thus adhere to the steel wall through their own magnetic attraction.

In the operation of the described system it is highly desirable that ferromagnetic items be removed in some manner from the commingled materials prior to their being loaded into the supply hopper. This can be done in any of several ways, such as by a conventional magnetic pulley and belt device as is well known. Thus only nonferromagnetic commingled materials are fed through chute 14 to the drum.

Figure 2:
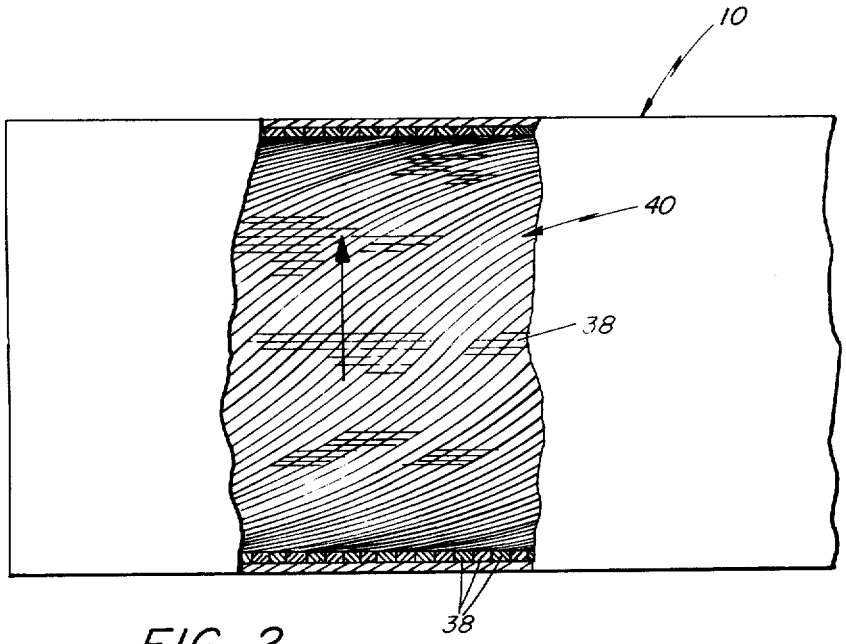
FIG. 2 is an elevational view of the rotary drum partly in axial section to show the magnet array therein.

The magnets 38 in the array, indicated by numeral 40 in FIG. 2, are of substantially uniform thickness and provide at their common exposed surface an alternating array of north and south magnetic poles which establish along the surface a sequentially alternating series of oppositely directed static magnetic fields. Extending from any particular north magnetic pole of the array are flux lines which bend upwardly of the sloped inclined surface defined by the angle of inclination of the drum and other flux lines which bend downwardly thereof to enter respective adjacent south magnetic poles on either side of the source magnet 38. Accordingly, between any three adjacent magnetic poles of the array, there is established a sequential pair of oppositely directed magnetic fields, which extend around the inner circumference of the magnet array and at a substantially uniform angle with respect to the longitudinal direction thereof. The lines of magnetic flux associated with the alternating series of oppositely directed magnetic field extend above the surface of the array and are cut by the nonferromagnetic items as the drum and consequentially the magnet array is rotated.

It has been found that when the drum and magnet array are rotated in the direction indicated by the arrow in FIG. 2, the magnetic fields passing sequentially through the materials will cause a series of eddy currents to be induced in conductive items among the commingled materials. This creates a force which causes actual movement of the conductive items upwardly along the inclined bottom of the drum. The direction of rotation determines the direction of motion induced in the conductive items by such electromagnetic forces. This action is fully described in the aforementioned copending U.S. patent application Ser. No. 552,576. The structure described in said copending application differs in that the commingled materials are made to slide down a ramp over an array of magnets, whereupon conductive items are moved laterally by the electromagnetic forces, while in the present invention the magnet array moves with respect to the materials causing electromagnetic forces to move conductive items towards the upper opening of the drum.

From the above it will be understood that conductive items will be continually moved upwardly to a point where they will eventually fall out the upper end of the drum into collector 34. Since nonconductive items will be substantially unaffected by the magnetic fields and consequently will not have eddy currents induced in them, they will gradually slide down and out the lower end of the drum into collector 36. For more details of the theory relating to the magnetic fields and their relations to the conductive items, reference should be had to the aforementioned copending application Ser. No. 552,576, now U.S. Pat. No. 4,003,850.

It will be understood that the actual separation of different conductive and nonconductive materials may be optimized as desired by varying the angle of inclination of the drum and/or the rotational speed of the drum.

It is highly desirable that the array 40 of magnets 38 extend all the way to the ends of the drum, especially to the upper end, so that efficient removal of conductive items from the drum is achieved. However, means such as rings 58 may be provided at the ends of the magnet array to prevent displacement of the array axially of the drum, which rings 58 may be bolted or otherwise affixed to the peripheral ends of the drum in overlying relation to the ends of the magnet array.

Thus, it will be apparent that commingled nonferromagnetic materials may be separated as described into conductive and nonconductive materials. However, in the event that ferromagnetic materials for some reason are not previously separated from the commingled materials loaded into the hopper 12, this can be done in the embodiment of the invention shown in FIGS. 3–5 wherein the commingled materials are not only separated into conductive and nonconductive fractions but also into a third fraction consisting of magnetic materials.

Figure 3:
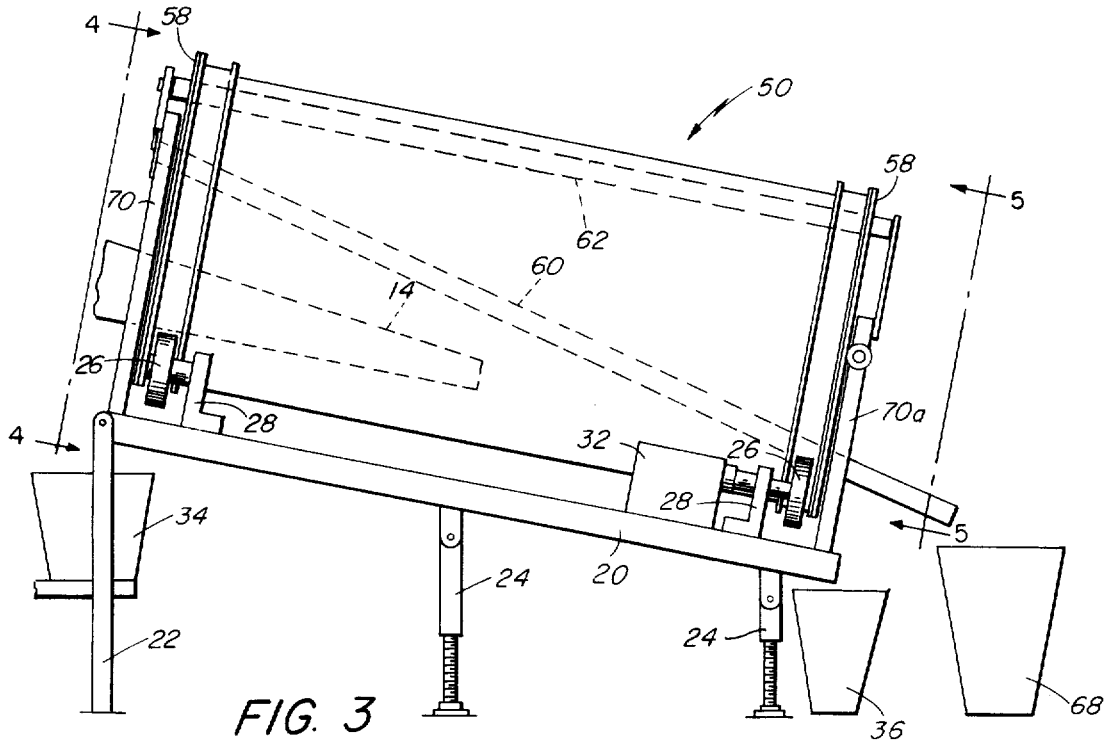
FIG. 3 is a side elevational view of a second embodiment of the rotary drum shown in FIG. 1.

The drum 50 in the FIG. 3 structure is mounted on bed 20 supported by jack posts 24 for adjustment to a desired angle of inclination about a pivot at the upper end of frame member 34 as in the FIG. 1 structure. The drum 50 is supported on the bed 20 by means of rollers 26 carried by brackets 28 fixed to the bed 20 with one roller 26 being connected to a motor 32 to rotate the drum about its axis, as in the FIG. 1 structure.

Figure 4:
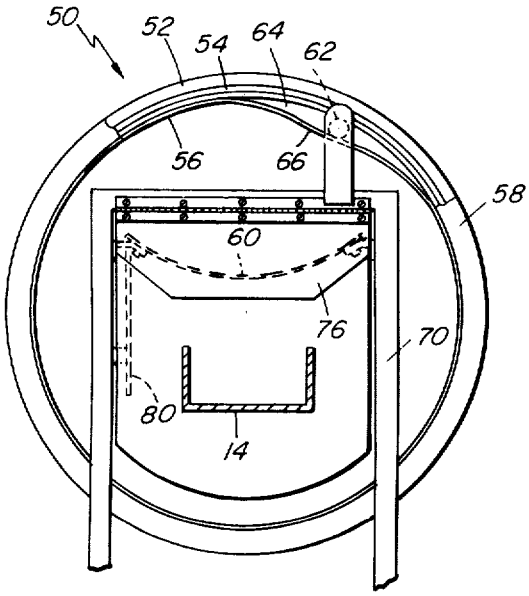
FIG. 4 is an end view taken on line 4—4 of FIG. 3 looking in the direction of the arrows.
Figure 5:
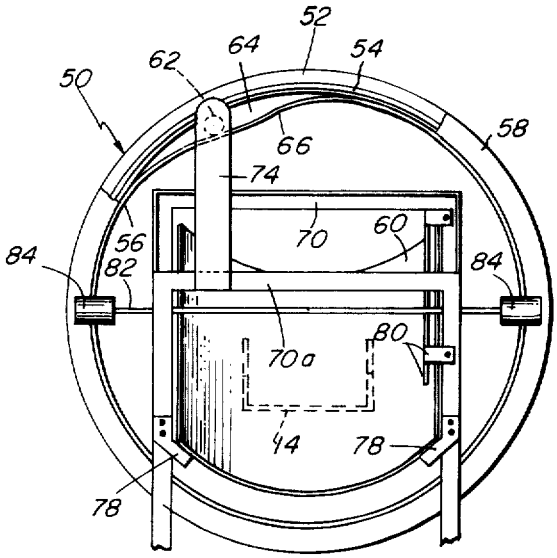
FIG. 5 is an end view taken on line 5—5 of FIG. 3 looking in the direction of the arrows.

As seen best in FIGS. 4 and 5, drum 50 comprises an outer cylinder 52 of rigid material such as steel which has on its inner surface a magnetic layer 54 similar to magnet array 40 and comprised of magnets arranged in stripes around the inside of the drum which stripes are oppositely polarized and disposed in parallel contiguous fashion at an angle as shown in FIG. 2.

The drum 50 is fed with a commingled mixture of ferromagnetic and nonferromagnetic materials by means of chute 14 and the conductive materials are separated from the nonconductive materials as the drum is rotated, as described in connection with the operation of the FIG. 1 embodiment.

However, since the commingled materials may contain magnetic items, it will be apparent that such magnetic items will be magnetically attracted to the magnets 54 and will magnetically adhere thereto, thus being carried round and round as the drum is rotated. This will obviously interfere with the separation of the conductive and nonconductive materials.

To overcome this problem the drum is provided with a flexible liner 56 which overlies the magnet array 54 and is formed of nonmagnetic material such as stainless steel or polytetrafluorthylene, for example. This liner 56 should be relatively thin so as to permit the magnetic fields in layer 54 to penetrate into the interior of the drum sufficiently to efficiently reach the materials being separated. Thus, magnetic materials will be magnetically attracted and held against the liner as the drum is rotated.

The ends of the liner 56 extend through the respective rings 58 and terminate substantially flush with the outer surfaces of the rings so that a smooth continuous surface is provided for maximum sliding motion of the materials within the drum.

Within the drum 50 above chute 14 is a chute or trough 60 which extends substantially the full length of the drum and is inclined with respect thereto as shown in FIG. 3, with its lower end projecting outwardly from the lower open end of the drum. Adjacent the top of the drum 50 the liner 56 is pulled away from the magnet array 54 by a longitudinally extending roller 62 which lies between the magnet array and liner. Thus, as the drum 50 is rotated about its axis the liner moves with it and carries upwardly any magnetic items which may be attached. As the magnetic items reach the area 64 where the adjacent portion 66 of the liner is pulled away from the magnet array 54 by roller 62, these magnetic items are removed sufficiently far enough away from the magnets as to be unaffected by the magnetic fields therefrom. Consequently, since the magnetic attraction is removed, these magnetic items fall into the inclined trough 60 and slide down therein and out the lower end into a separate collector 68. Thus, the magnetic items are collected as a third fraction separated from the nonmagnetic conductive items and residue of nonconductive nonmagnetic items.

The trough 60 and roller 62 may be supported within the drum 50 by any suitable means. Such means may comprise vertically extending rigid metal frames 70 and 70*a* at the respective upper and lower ends of the drum and fixed to the bed 20 independently of the drum. Each frame has an upright extension 74 between which the roller 62 extends, the ends of the roller being rotatably secured to the extensions 74. The upper end of trough 60 is secured to the upper frame 70 and covered by a hinged plate 76 (FIG. 4) which provides ready access to the upper end portion of the trough for cleaning or the like. The lower end of trough 60 may be supported on frame 70*a* as by brackets or lugs 78 (FIG. 5). The frame 70*a* at the lower end of the drum carries a transversely extending rod 82 upon the ends of which rollers 84 are rotatably mounted. Rollers 84 bear upon the adjacent end of the liner 56 to prevent its axial displacement within the drum.

A deflector plate 80 is secured by bolts or the like to the frames at one side of the trough 60 so as to deflect magnetic items into the trough in cases when the drum is rotated at a sufficiently rapid rate as to create centrifugal forces which act upon the magnetic items as they become separated from the liner 56.

From the foregoing it will be apparent that novel apparatus has been provided for separating conductive and nonconductive items from commingled materials and for further separating magnetic items therefrom as described. It is to be understood, however, that various modifications and changes in the structures shown and described and in their methods of operation may be made by those skilled in the art without departing from the spirit of the invention as expressed in the accompanying claims. Therefore, all matter shown and described is to be interpreted as illustrative and not in a limiting sense.

What is claimed is:

1. A magnetic rotary drum materials separating system for separating electrically conductive items from a supply of commingled materials comprising a drum disposed at a selected angle to the horizontal, said drum having on its inner surface means for separating electrically conductive items from nonconductive items in said supply, said means comprising steady-state magnetic means for establishing an alternating series of oppositely directed magnetic fields throughout a major portion of the interior of the drum at an angle to the axis thereof, said steady-state magnetic means including an array of alternating north and south magnetic pole pieces lining the inner side of the drum, said array comprising a plurality of magnets arranged in strips disposed in substantially parallel relation with each other in spirals arranged around the interior of the drum at a selected angle to said axis and in a predetermined direction; means for depositing a supply of commingled materials to be separated on said steady-state magnetic means within the drum at an axial midpoint thereof, and means for rotating the drum and said magnetic means about the longitudinal axis of the drum in a direction opposite to the direction of said spirals for causing the alternating oppositely directed magnetic fields to pass sequentially through said commingled materials and causing eddy currents to be induced in electrically conductive items in the comingled materials to produce force components which move said conductive items progressively axially upwardly toward the upper end of the drum.

2. A rotary drum classifier system for separating electrically conductive materials from nonconductive materials in a supply of commingled materials, comprising a drum disposed with its longitudinal axis at a selected angle of inclination to the horizontal, said drum having disposed on its inner side an array of permanent magnets arranged in contiguous parallel alternatingly polarized rows extending in spirals around the interior of the drum at a selected angle to said axis and in a predetermined direction and producing an alternating series of oppositely directed magnetic fields extending into the interior of the drum, at an axial midpoint thereof means for depositing commingled materials within the drum and in the magnetic fields, and means for rotating the drum and magnet array about said axis to cause the alternating magnetic fields and in a direction opposite to that of said spirals to pass sequentially through said commingled materials whereby eddy currents induced in electrically conductive items in the commingled materials will produce force components which move said items progressively axially upwardly toward the upper end of the drum.

3. A classifier system as set forth in claim 2 wherein said angle of inclination of the drum is selected to cause remaining nonconductive items to proceed axially downwardly within the drum.

4. A classifier system as set forth in claim 3 wherein said drum is mounted for vertical adjustment to control the angle of inclination and thereby the degree of separation efficiency.

5. A classifier system as set forth in claim 2 wherein said drum is of a magnetic material and said magnets are secured to the drum by their own magnetic attraction and rotate therewith.

6. A classifier system as set forth in claim 5 wherein a ring is secured to each end of the drum in overlying relation to the ends of the magnet array for preventing axial displacement of the array.

7. A classifier system as set forth in claim 2 wherein each row in said magnet array comprises a single individual magnet.

8. A classifier system as set forth in claim 2 wherein each row in said magnet array comprises a plurality of magnets disposed in end-to-end relation.

9. A rotary drum classifier system as set forth in claim 2 wherein said drum further includes means for separating magnetic items from said commingled materials.

10. A rotary drum classifier system for simultaneously separating magnetic items, electrically conductive items and nonconductive items in a supply of commingled materials, comprising a drum disposed with its longitudinal axis at a selected angle of inclination to the horizontal, said drum having on its inner side an array of permanent magnets arranged in continuous parallel alternatingly polarized rows extending in spirals around the interior of the drum at a selected angle to said axis in a predetermined direction and producing an alternating series of oppositely directed magnetic fields extending into the interior of the drum, a flexible liner of nonmagnetic material disposed over the surface of said magnet array and supported for movement with the drum, the liner being sufficiently thin to permit said magnetic fields to extend therethrough, means for depositing a supply of commingled materials in said drum on said liner at an axial midpoint thereof and within the magnetic fields, and means for rotating the drum and consequently the magnet array and liner about said axis of the drum in a direction opposite to that of said signals to cause magnetic items on the commingled materials in the drum which have been magnetically attracted to the liner to be moved with the liner circumferentially upwardly out of the supply of commingled materials, and to simultaneously cause the alternating magnetic fields to pass sequentially through said supply of commingled materials whereby eddy currents induced in electrically conductive items therein will produce force components which move said conductive items progressively axially upwardly toward the upper end of the drum, and further to simultaneously cause the remaining nonmagnetic nonconductive items to proceed axially downwardly in the drum.

11. A system as set forth in claim 10 wherein means is provided in said drum for separating and removing the magnetic items which were magnetically attached to the liner.

12. A system as set forth in claim 10 wherein a chute is provided within the drum together with means for separating said magnetic items from the liner and causing said magnetic items to be deposited in said chute.

13. A system as set forth in claim 12 wherein said separating means comprises a roller extending axially of the drum between the liner and the magnet array in an upper area of the drum, the roller being of a diameter which will space the adjacent portion of the liner sufficiently from the magnet array to cause magnetic items to be unaffected by the magnetic fields in this area of the drum and to thereby fall into said chute for removal from the drum.

14. A system as set forth in claim 13 wherein support means are located at each end of the drum and said roller and chute are connected to said support means for support independently of said drum.

15. A system as set forth in claim 13 wherein deflection means is provided adjacent one side of said chute for deflection into the chute of magnetic items being released from the liner and influenced by centrifugal forces.

16. A rotary drum materials separating system for separating magnetic materials from commingled magnetic and nonmagnetic non-conductive materials, comprising a drum disposed at an angle to the horizontal, said drum having on its inner surface an array of permanent magnets arranged in continuous parallel alternatingly polarized rows extending in spirals in a predetermined direction around the interior of the drum at a selected angle to said axis for establishing magnetic fields extending into the interior of the drum, a flexible liner of nonmagnetic material disposed over the surface of said magnet array and supported for movement with the drum, the liner being sufficiently thin enough to permit said magnetic fields to extend therethrough, means for depositing a supply of commingled magnetic and nonmagnetic materials in said drum on said liner and within the magnetic fields, means for rotating the drum and consequently the magnet array and liner about the longitudinal axis of the drum to cause magnetic items in the commingled materials in the drum which have been magnetically attracted to the liner to be moved with the liner circumferentially upwardly away from the nonmagnetic items, and means for removing the separated magnetic items from the drum.

17. A system as set forth in claim 16 wherein said means for removing the magnetic items includes a chute within the drum, and means for separating said magnetic items from the liner and causing said magnetic items to be deposited in the chute.

18. A system as set forth in claim 17 wherein said means for removing the magnetic items comprises a roller extending axially of the drum between the liner and the magnet array in an upper area of the drum, the roller being of a diameter which will space the adjacent portion of the liner sufficiently from the magnet array to cause magnetic items to be unaffected by the magnetic fields in this area of the drum and to thereby fall into said chute for removal from the drum.

* * * * *